United States Patent [19]

Cortese

[11] 3,964,180

[45] June 22, 1976

[54] STANCE CONTROL SUPPORTS FOR, AND COMBINATION THEREOF WITH, A GOLF SHOE

[76] Inventor: Anthony M. Cortese, 327 Applehill Drive, Sagamore Hills, Ohio 44067

[22] Filed: Sept. 9, 1974

[21] Appl. No.: 504,545

[52] U.S. Cl. ..... 36/135

[51] Int. Cl.[2] ..... A43B 5/00

[58] Field of Search.... 36/2.5 AH, 2.5 AN, 2.5 AM, 36/2.5 A

[56] References Cited

UNITED STATES PATENTS

| | | | |
|---|---|---|---|
| 2,847,769 | 8/1958 | Schlesinger | 36/2.5 AH |
| 3,020,654 | 2/1962 | McCann | 36/2.5 AN |
| 3,789,523 | 2/1974 | Rubin | 36/2.5 AH |

FOREIGN PATENTS OR APPLICATIONS

| | | | |
|---|---|---|---|
| 1,141,593 | 3/1957 | France | 36/2.5 AH |

*Primary Examiner*—Alfred R. Guest
*Attorney, Agent, or Firm*—John Harrow Leonard

[57] ABSTRACT

A plurality of like detachable stance control supports are detachably connected to spikes of a golf shoe of the type having conventional spikes arranged in two rows spaced apart from each other laterally of the sole and heel of the shoe at opposite sides of the midportions of the sole and heel, one row being an outer row near the outer lateral limit of the sole and heel and the other row being an inner row near the inner lateral limit of the sole and heel. The control supports are connected to selected spikes, respectively, of the outer row and aid a golfer in assuming the proper stance, in addressing the ball, by tilting of the shoe and heel of the right shoe, and therefore the right foot, so that the weight supported by the right leg is directed through the inner side of his foot more nearly beneath the instep. The supports are of such size and shape that when they are installed on their associated spikes, they are spaced laterally from, and isolated from, each other, and are unconnected with each other in any manner except insofar as connected through the medium of the sole or heel of the shoe itself. The ground engaging surfaces of the supports are of such size as to prevent their penetration of the ground under normal ground conditions. Each control support is magnetically detachably held in proper position on its associated spike and can be readily installed or removed by hand, and without any tools, independently of the other like supports, thereby to permit walking with the right sole and heel in normal ground engaging positions.

10 Claims, 4 Drawing Figures

STANCE CONTROL SUPPORTS FOR, AND COMBINATION THEREOF WITH, A GOLF SHOE

BACKGROUND OF INVENTION

1. Field of Invention

A stance control support detachably connectable to a spike of a golf shoe for preventing penetration of the spike into the ground under normal ground conditions wherein the other spikes, which are free from such a support, can penetrate the ground, and a combination with a golf shoe of a plurality of such supports.

2. Description of the Prior Art

Golf is a game that requires acute concentration in all areas. Even a professional golfer whose swing is automatic is prone to lose his concentration under pressure and therefore address the ball with an improper stance. The present invention is to eliminate the need for concentration in one important area so as to allow the golfer, professional or amateur, to assume the proper stance more readily and therefore enable him to devote more concentration to other factors affecting his swing.

The most difficult part of the golf swing, and one that is neglected by most golfers, is keeping the weight on the inner side of the right foot, more nearly beneath the right instep, on the back swing and down swing. The present invention assists in maintaining this particular stance.

Prior structures directed to this end include an unspiked shoe with the sole and heel each of greater thickness at the outer side of the shoe than at the inner side, thus tilting the foot of the wearer, but such are permanent and impose an unnatural position of the foot for walking.

SUMMARY

The supports of the present invention are detachably attached to the selected ones of the conventional golf shoe spikes near the right lateral limit of the right sole and heel of the right shoe by means of magnetic force. Each support is a cylindrical body of relatively rigid material with the center portion of the body at the top being magnetic. The body has a central cavity which extends endwise thereof and is closed at its lower end. The cavity is open at its upper end, opening into a shallow concavity in the upper face of the body. This concavity, in turn, is open at the upper end of the body. The cavity and concavity are shaped so that the cavity can receive a conventional golf shoe spike endwise and accommodate it while the upper face of the shallow concavity seats against the downwardly convex peripheral flange conventionally provided at the base of the spike. As a result the supports transmit load on the selected spikes to the ground.

By attaching the supports to selected spikes at the right side of the shoe and heel of the right shoe, these spikes are prevented from penetrating the ground and thus keeping the right side of the right shoe and of the right foot elevated relative to the left side, thereby shifting the weight on the right leg to the inside of the right foot more nearly beneath the instep.

The supports are individually attachable and detachable readily by hand and are spaced apart and isolated from each other and unconnected to each other by any extraneous means other than the sole and heel of the shoe. The main effect of the installed supports is to aid golfers to master more readily one of the most difficult parts of the golf swing which is keeping the weight of his body on the inner side of the right foot during his back swing and down swing, rather than permitting the weight to shift to the outside of the right foot, which latter causes swaying, stiffening, or buckling of the right leg, thus reducing power and control of the swing. Such elevation of the right side of the right foot automatically causes the golfer to flex the right knee and settles the weight of the player to the inside of the right foot. The proper use of the supports gives the golfer a springboard to push off the inside of the right foot, thus adding on the down swing the element of power derived from the legs.

DESCRIPTION OF THE PREFERRED EMBODIMENT

Figure 1:
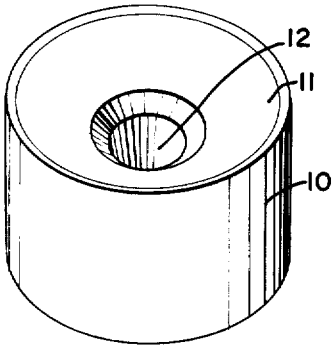
FIG. 1 is a perspective view of a preferred embodiment of one of the stance control supports of the present invention.
Figure 2:
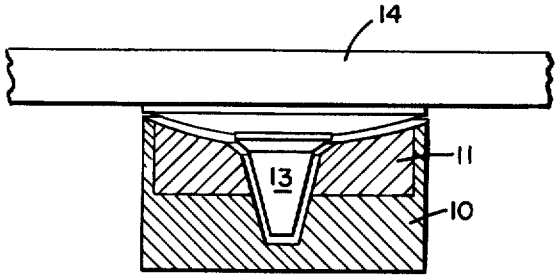
FIG. 2 is a longitudinal axial sectional view of the support illustrated in FIG. 1.
Figure 3:
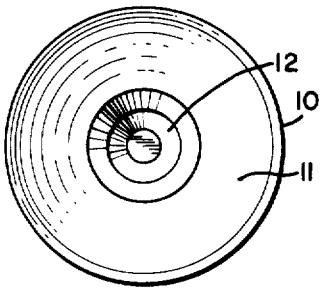
FIG. 3 is a top plan view of the support illustrated in FIG. 1.

Referring to the drawings, the support preferably comprises a relatively rigid cylindrical body 10 in the upper portion of which is mounted magnetic means. The magnetic means, as shown, is an annular permanent magnet having its upper face exposed upwardly at, and forming a part of, the upper end of the body 10. This upper face is concave upwardly, thus providing a shallow concavity which, at its lower end, connects with a cavity 12 extending through the magnet 11 and into the lower portion of the body 10. The cavity 12 is closed at its lower end. The shoe has a conventional spike which has a basal flange 13*a* and, extending outwardly from the outer end of the basal flange, has a wide peripheral flange 13*b*, as illustrated in FIG. 2.

The central cavity 12 is shaped to accommodate the main body of the spike 13 with the upper end fitting the basal flange 13*a*. The shallow concavity in the upper end of the body is shaped to fit substantially the under downwardly covex face of the peripheral flange 13*b* of the spike.

The body 10 can readily be installed by hand on the spike 13 and held in the installed position thereon by magnetic force. The body 10, when installed, keeps the golf spike on which installed from penetrating the ground, and is of such size and cross section at its lower face that it, itself, does not sink into the ground under normal ground playing conditions.

Figure 4:
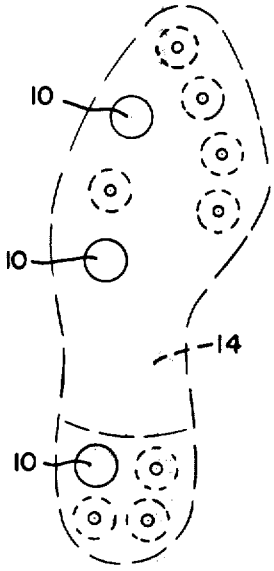
FIG. 4 is a diagrammatic bottom plan view of a golf shoe for the right foot, with a plurality of the stance control supports of the present invention installed thereon.

On the conventional golf shoe, the spikes are arranged in two rows spaced laterally from each other at opposite sides of the central portion of the shoe sole and heel, thus providing an outer row near the outer or right hand lateral limit of the right hand sole and heel and an inner row near the inner lateral limit of the right hand sole and heel. When a number of the supports are attached to the spikes of the outer row of the right shoe, indicated at 14 in FIG. 4, the outer spikes and supports cannot penetrate the ground while the inner row of spikes penetrate the ground freely. As a result the shoe is elevated at its right side forcing the weight of the player's body carried by the right leg to be applied to the inner or left side of the sole and heel of the right foot. This elevation of the right side of the right shoe causes the right knee to flex slightly, thus forcing the golfer to exert a push off the inside of the foot on the down swing, giving maximum power and control.

Having thus described my invention, I claim:

1. In combination with a golf shoe for the right foot and having a sole and spikes carried by the sole and protruding downwardly therefrom and arranged in inner and outer rows, respectively, extending from near the front of the sole to and including the heel of the shoe, and arranged in laterally spaced relation to the central portion of the shoe and heel with the inner row near the inner lateral limit of the sole and heel and the outer row near the outer lateral limit of the sole and heel;

stance control supports for the sole and heel;

each support being a relatively rigid body and having a cavity open through the upper face and in which an associated spike of said inner row is received in the installed position of the support, said lower face being of an area several times the area of the maximum cross section of the normal ground penetrating portion of the associated spike and each support, in installed condition, being in endwise load transmitting relation to its associated spike;

magnetic means carried by the upper portion of the body and magnetically cooperative with the associated spike and detachably holding the body in said installed position;

a plurality of said supports being installed on spikes, respectively of said outer row only; and the inner row of spikes being free from said supports, and unobstructed so that they can normally penetrate into the ground.

2. The combination in accordance with claim 1 wherein at least one support is mounted on one of the spikes of the outer row which one spike is on the heel of the shoe.

3. The combination in accordance with claim 1 in which at least two supports are mounted on two of the spikes, respectively, of the outer row of spikes which two spikes are on the sole of the shoe.

4. The combination according to claim 3 in which said two spikes are spaced apart from each other in said outer row at opposite sides of a spike of said outer row which is without such a support.

5. The combination according to claim 3 wherein one support is mounted on a spike of the outer row which is the rearmost on the sole and at least one support is mounted on a spike of the outer row which is on the heel.

6. The combination according to claim 1 wherein the upper face of the body of each support has a relatively shallow concavity which is open upwardly and which approximately fits the under face of a peripheral flange of the associated spike, which flange is at the base of the spike and is juxtaposed against the sole or heel of the shoe.

7. The combination according to claim 1 wherein, as to each support, the magnetic means is an annular magnet having an axial passage therethrough;

said passage forms the upper portion of said cavity; and said magnet has its upper face exposed upwardly, and said shallow concavity is in the upper end of the magnet and open in said upper face.

8. The combination according to claim 1 wherein each of said supports is a unitary structure, complete in and of itself, and is free from any means interconnecting it with any one of the other supports.

9. A stance control support comprising a relatively rigid weight supporting body detachably connectable to one of the conventional downwardly projecting spikes of a golf shoe, which spike has a downwardly convex peripheral flange at its base;

said body having an upper end face and a lower end face, said body having a shallow concavity at its upper end which concavity is shaped to accommodate and approximately fit said flange in the installed position of the associated spike, and which opens at its upper end through the upper end of the body;

said body having a cavity extending endwise of the body and opening at its upper end into the lower end of said concavity;

said cavity being shaped to receive endwise and accommodate said golf shoe spike with said concavity fitting the peripheral flange on the base of said spike, said lower end face being adapted and arranged for direct engagement with the ground for transmitting thereto weight imposed on the shoe by the wearer thereof;

magnetic means carried by the upper portion of the body in surrounding relation to the axis of the body for detachably magnetically holding the support in said installed position;

the size and shape of the body cross section being such that a plurality of the supports can be installed, on adjacent spikes, respectively, of a golf shoe and, when all are so installed, they will be in laterally spaced relation to, and isolated from, each other; and said support being a unitary structure complete in and of itself and free from any means for interconnecting it with other like supports in the installed position and when uninstalled.

10. The structure according to claim 9 wherein the cavity is closed permanently at its lower end by a wall portion of the lower end of the body, which wall portion is of substantial thickness and capable of transmitting load on the support to the ground.

* * * * *